US007927427B2

(12) United States Patent
Classen et al.

(10) Patent No.: US 7,927,427 B2
(45) Date of Patent: Apr. 19, 2011

(54) METHOD FOR DETECTING THE LOAD OF ITEMS TO BE WASHED, AND DISHWASHER MACHINE

(75) Inventors: Egbert Classen, Stahnsdorf (DE); Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 12/848,261

(22) Filed: Aug. 2, 2010

(65) Prior Publication Data

US 2010/0294311 A1 Nov. 25, 2010

Related U.S. Application Data

(62) Division of application No. 11/628,520, filed as application No. PCT/EP2005/053510 on Jul. 20, 2005.

(30) Foreign Application Priority Data

Jul. 23, 2004 (DE) ..... 10 2004 035 847

(51) Int. Cl.
*B08B 3/02* (2006.01)

(52) U.S. Cl. ..... 134/18; 134/25.2

(58) Field of Classification Search ..... 134/56 D, 134/58 D, 113
See application file for complete search history.

(56) References Cited

U.S. PATENT DOCUMENTS

| | | | | |
|---|---|---|---|---|
| 5,656,932 | A * | 8/1997 | Kitayoshi | 324/615 |
| 6,675,818 | B1 * | 1/2004 | Schrott et al. | 134/57 D |
| 6,825,455 | B1 | 11/2004 | Schwarte | |
| 7,358,473 | B2 * | 4/2008 | Aoki et al. | 250/205 |
| 2005/0011544 | A1 | 1/2005 | Rosenbauer et al. | |

FOREIGN PATENT DOCUMENTS

| | | | |
|---|---|---|---|
| DE | 19704496 | A1 | 3/1998 |
| DE | 10048081 | A1 | 4/2002 |
| DE | 10048086 | A1 | 4/2002 |
| EP | 0943287 | A1 | 9/1999 |
| EP | 1192893 | A2 | 4/2002 |
| JP | 2003-235781 | A | 8/2003 |

* cited by examiner

*Primary Examiner* — Frankie L Stinson
(74) *Attorney, Agent, or Firm* — James E. Howard; Andre Pallapies

(57) ABSTRACT

A method for determining at least one of the type and the quantity of items to be washed in a dishwasher machine is provided for use with a dishwashing machine having a washing chamber in which the items are placed in receptacles for subsequent washing of the items during a dishwashing program with the respective disposition of the items in the receptacles constituting the load of the receptacles in the washing chamber of the dishwasher machine. The method includes detecting the load of the receptacles by an image detection system that measures distances in a non-contact manner by means of the speed of light such that the measured distances can be evaluated to obtain a three-dimensional image of the washing chamber.

9 Claims, 1 Drawing Sheet

METHOD FOR DETECTING THE LOAD OF ITEMS TO BE WASHED, AND DISHWASHER MACHINE

CROSS REFERENCE TO RELATED APPLICATIONS

This application is a divisional under 35 U.S.C. §121 of U.S. application Ser. No. 11/628,520, filed Nov. 29, 2006, which is a U.S. national stage application, under 35 U.S.C. §371, of International Application No. PCT/EP2005/053510, filed Jul. 20, 2005, which designated the United States; this application also claims the benefit under 35 U.S.C. §119 of German Patent Application No. 10 2004 035 847.8, filed Jul. 23, 2004.

BACKGROUND OF THE INVENTION

The invention relates to a method for detecting the load of items to be washed in a dishwasher machine in which the items to be washed are placed in receptacles in the washing chamber of the device, wherein the loading of the receptacles for the items to be washed is detected by an image detection system. The invention further relates to a dishwasher for carrying out the method.

Program-controlled dishwashing machines, in particular used in the household, can be operated in an energy-saving manner by setting the power and water consumption in relation to the quantity of crockery or items to be washed which is loaded in the receptacles for washing.

For example, it is known from EP 0 943 287 A1 to arrange sensors for detecting electromagnetic waves and/or sound waves a large distance apart from one another in the washing container of the device, in particular on a spatial diagonal, wherein each sensor is assigned a transmitter which transmits light signals or acoustic signals. When the transmitter emits signals, these are partially reflected by the loaded items to be washed and/or optionally reach a receiver (sensor) in a time-delayed manner. The temporal evaluation of the signals received by the sensors then gives an indication of the arrangement of the items to be washed or the quantity of crockery. The quantity of crockery or the load of items to be washed determined in each case is registered and the sequence of the washing program for treating these items to be washed is influenced. This can take place, for example, by supplying washing liquid into the washing container according to the load and by heating the washing liquid adapted to the load.

A disadvantage of this arrangement can be seen in that crockery parts located in the transmission beam of the signal emitter reflect and deflect the electromagnetic waves or acoustic waves emitted by the transmitters with the result that items to be washed optionally positioned therebehind in the crockery basket are not precisely detected despite the diagonal alignment of the transmitter and receiver. The load recognition is therefore inaccurate and additionally provides only a two-dimensional image of the loading of the receptacle for the items to be washed.

DE 100 48 081 A1 further discloses to provide one or more separate image detection or image detection systems as well as one or more lighting devices to detect the type and quantity of the loading of items to be washed in the washing container and/or on the side of the appliance door facing the washing container. In this case, the image detection systems can be embodied in the manner of commercially available black/white and/or colour mini cameras (mini cameras).

A disadvantage of this arrangement is that camera systems of the specified type are expensive and are not designed per se for use in water-carrying appliances. In addition, sufficiently strong lighting must be provided in the washing chamber to create sufficient brightness for the image detection system to photograph the washing chamber. In addition, the proposed system can only produce a two-dimensional image of the items to be washed positioned in the washing chamber.

The use of an optical scanning device in the fashion of a laser scanner is also known for detecting the load of a dishwasher machine, said scanner being disposed in front of the washing chamber opening to detect the items to be washed. The laser scanner derives information on the type of crockery items by image detection of the items to be washed, wherein corresponding signal patterns are generated by the scanner and fed to the program controller. The loading quantity is determined in this case by counting the crockery items loaded in the washing container. Such a dishwasher machine is described in DE 100 48 086.

A similar principle is used in EP 1 192 893 A2, where a light curtain is disposed in the washing chamber opening and the crockery load of the washing container can be concluded from the profile of the light interruptions thus produced.

Finally, the use of a camera is known from DE 101 62 505 A1, this camera being used to identify items to be washed with particularly stubborn contamination so that these crockery items can then be subjected to more intensive cleaning.

So-called photonic mixer devices (PMD) which can determine three-dimensional distance images are known as alternative sensors. Such photonic mixer devices or photomixing detectors are described in DE 197 04 496 A1. In order to determine the phase and/or amplitude information of an electromagnetic wave, a pixel of a photonic mixing element has at least two light-sensitive modulation photogates and allocated accumulation gates. Gate voltages are applied to the modulation gates whereas a DC voltage is applied to the accumulation gates. The charge carriers generated by an incident electromagnetic wave in the space charge zone of the modulation photogates are exposed to the potential gradient of a drift field depending on the polarity of the gate voltages and drift to the corresponding accumulation gate. Photomixing detectors of the type described in this document are used in automobile-related applications to detect impending collisions from the three-dimensional images determined of the surroundings and to initiate countermeasures.

BRIEF SUMMARY OF THE INVENTION

It is the object of the invention to provide a method and a dishwasher machine with which the type and quantity of items to be washed, which have been loaded into the dishwasher, can be optimally determined.

In the method according to the invention for determining the type and/or quantity of items to be washed in a dishwasher machine, an image detection system is used which measures distances in a non-contact manner by means of the speed of light in order to obtain a three-dimensional image of the washing chamber. The particular advantage of this procedure is that the evaluation of a three-dimensional image which in particular takes into account the distance of the respective items to be washed from the image detection system can give a more reliable image of the load of items to be washed than is the case in the procedure known from the prior art, wherein only one two-dimensional image of the load of items to be washed can be generated.

The image detection system of the dishwasher machine according to the invention has at least one transmitter which emits modulated electromagnetic waves, and at least one photo-sensitive pixel element which is located in the washing chamber and/or on the side of the appliance door facing the washing container as well as, furthermore, an evaluation unit which determines a three-dimensional image of the washing chamber from the transit time of the electromagnetic waves.

The photosensitive pixel elements preferably comprise so-called pixel elements known from the prior art, e.g. DE 197 04 496 C2. Such a pixel element is capable of measuring distances in a non-contact manner by means of the speed of light in order to determine three-dimensional images therefrom. In this case, the surroundings are illuminated with ultrafast pulsed electromagnetic waves. These waves are used as a time reference and are invisible to the human eye. The photosensitive pixel elements comprise a photodiode with two outputs which alternately read out the reflected light at a very high clock rate and thus calculate information on the transit time of the electromagnetic waves. The different distances of the "illuminated" items to be washed can be concluded from the different transition times, An image detection system having such a structure can be integrated in a single chip and can be produced cost-effectively using commonly used CMOS semiconductor production processes. A considerable economic benefit can be achieved by this means compared with the camera systems known from the prior art. Compared with an image detection system based on a mini camera, high-powered illumination can be dispensed with so that the energy consumption can advantageously be reduced.

Depending on the arrangement of the image detection system, a plurality of photosensitive pixel elements e.g. in the arrangement of an array, can be provided in the washing chamber.

It is advantageous to assign one or more image recognitions system(s) to at least each receptacle for items to be washed which separately determines the load of items to be washed in each receptacle.

In a further appropriate embodiment, it is provided that an image detection system should be assigned to the filter for collecting contamination residue. When contamination residue is detected in the filter, a signal which is identifiable for the user of the dishwasher machine, for example, can be emitted to indicate cleaning of the filter. This ensures that the cleaning performance of the dishwasher machine is the best possible in every washing process.

The arrangement of the image detection systems is preferably diagonal with reference to the crockery baskets so that all the crockery items or items to be washed can be correctly detected in the respective crockery baskets. Optionally, it can be advantageous to allocate a plurality of image detection systems to a respective crockery basket in order to ensure that covered areas for one image detection system are detected by the or one of the other image detection systems.

According to an advantageous further development of the method according to the invention, the image detection system emits modulated electromagnetic waves into the washing chamber and reads out the reflected waves in order to obtain information on the transit time of the electromagnetic waves, the readout of the reflected waves being performed by means of a sensor with two outputs which are alternately read out by an evaluation unit.

According to another appropriate embodiment, the image detection of the loading of the washing chamber according to type and quantity can be made before beginning a washing program started by a user. After the load of the respective crockery baskets has been determined by the image detection system, the dishwashing agent and the washing liquid can be metered and their degree of heating can be determined depending on said load. If the upper and lower dishwashing baskets are differently loaded, a larger quantity of dishwashing liquid could be supplied to the more heavily loaded dishwashing basket. The precise knowledge of the load of items to be washed allows a respective washing program to be controlled as required.

In a further appropriate embodiment, the type and/or quantity of items to be washed is determined at certain intervals to determine a change in the items to be washed in the receptacles and to trigger an automatic start of the dishwasher machine when a predetermined occupancy of the receptacles for items to be washed is established. At the same time, a washing program adapted to the load of items to be washed is selected and executed by the dishwasher. The intervention of a user is superfluous as a result.

The items to be washed can be detected during introduction into the washing chamber or during loading of the receptacles for said items to be washed. For this purpose, the image detection system could be arranged on the side of the appliance door facing the washing chamber or on the upper side of the washing chamber. According to another embodiment, the image detection of the washing chamber is made when the items to be washed are placed in the receptacles. This can take place, for example, after the door is closed each time. This makes it possible to start the dishwasher machine automatically. The automatic start need not necessarily take place when all the storage possibilities provided for this purpose are occupied with items to be washed but can also take place depending on the items to be washed detected by the image detection system. Thus, for example, a largely complete load could be defined as the starting criterion, for example, when items to be washed predominantly made of glass are detected whereas a smaller number of pots or pans could result in an automatic start in the event of a smaller load. In other words, the automatic start and the choice of washing program can be made dependent on which type of items are to be cleaned in the dishwasher machine and optionally, on the degree of contamination of the respective items to be washed which can also be determined by the image detection system.

In an appropriate embodiment, a comparative image generated by a fully loaded dishwasher machine and stored in a memory in an evaluation unit of the appliance is compared with the actual load of the washing chamber detected by the image detection system and the result of the comparison is used as a criterion for the automatic program start and the suitable washing program of the dishwasher machine.

In a further advantageous embodiment, a washing program is influenced depending on the information determined by the image detection system. This could be made dependent on the items to be washed which are detected in the dishwasher machine. Different materials require a different dose of dishwashing agent, optionally a different temperature run and a different quantity of water.

In a further advantageous embodiment, the image detection system is used to recognise a filter of the dishwasher machine occupied with contaminant residue.

BRIEF DESCRIPTION OF THE DRAWING

The invention is explained in detail hereinafter in an exemplary embodiment with reference to the single FIGURE. This shows a dishwasher machine 1 in cross-section.

DETAILED DESCRIPTION OF EXEMPLARY EMBODIMENTS OF THE PRESENT INVENTION

Figure 1:
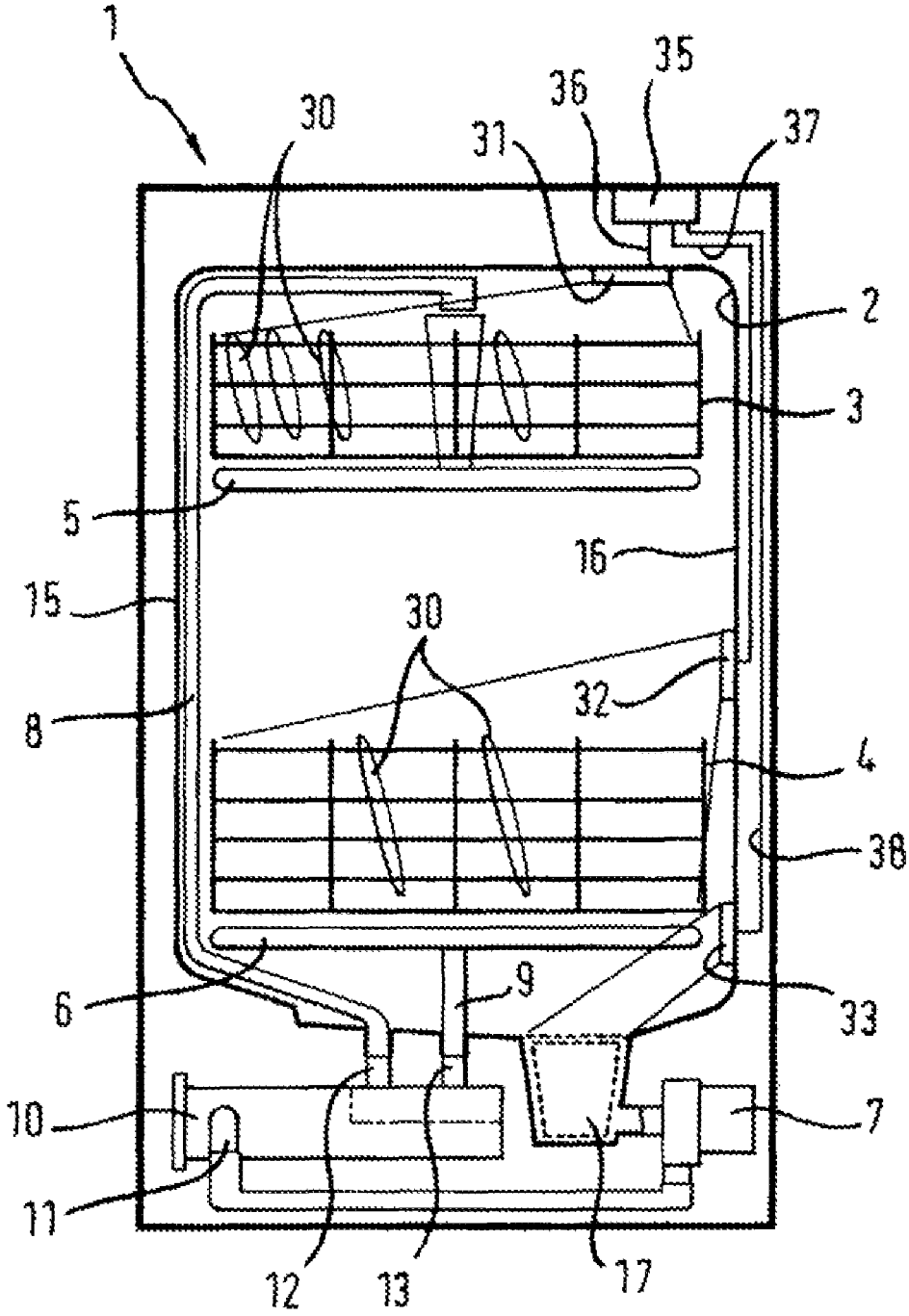

The dishwasher machine 1 according to the invention has a washing container 2 in which crockery 30 to be cleaned, for example in the form of plates, pots, cutlery etc. is usually loaded in crockery baskets 3, 4 forming receptacles for the items to be washed. Two spray devices 5, 6 are arranged in the washing container 2 to act upon the items 30 to be cleaned with washing liquid. The washing liquid is conveyed to the spray devices 5, 6 by means of a circulating pump 7 in liquid supply lines 8, 9.

Washing liquid conveyed into the dishwasher machine 1 is usually heated in a partial program section of a washing program for which a continuous flow heater 10 is used. The conveyed washing liquid is guided from the circulating pump 7 to an intake connection 11 of the continuous flow heater 10 and through said continuous flow heater 10. Said heater has at least two output connections 12, 13 from which the liquid is fed to the respective spray devices 5, 6 via liquid supply lines 8, 9. A heater not shown here is disposed in the continuous flow heater 10.

In order to measure the load of items to be washed in the crockery baskets 3, 4, image detection systems 31, 32, 33 are arranged inside the washing chamber 2. Each of the image detection systems 31, 32, 33 has at least one transmitter which emits modulated electromagnetic waves and at least one photosensitive pixel element. The image detection systems 31, 32, 33 are located in the washing chamber 2 and/or on an appliance door not shown in the FIGURE. Furthermore, the image detection systems 31, 32, 33 are connected via respective leads 36, 37, 38 to an evaluation unit 35. The evaluation unit 35 is capable of determining a three-dimensional image of the washing chamber from the transit time of the electromagnetic waves from their emission by the transmitter and the reception of the reflected waves by the receiver and therefore determining in particular the load of the respective crockery baskets 3, 4. The type and/or quantity of items to be washed in the crockery baskets 3, 4 can be determined using the three-dimensional image determined by a respective image detection system 31, 32, 33 and an evaluation of the determined images in the evaluation unit 35, which can take place, for example, by a comparison with previously stored reference images.

The photo-sensitive pixel elements are preferably embodied as PMD pixel elements (photomixing detectors). The operating mode of these PMD pixel elements is known from the prior art and is described, for example, in DE 197 04 496 C2 so that reference is made to this document with regard to more accurate technical details, the content of this document being explicitly declared as a component of this description.

The image detection systems 31, 32, 33 are preferably distributed over the inner side of the walls 15, 16 defining the washing chamber 2 and the upper side of the washing chamber 2. In particular, both the upper crockery basket 3 and also the lower crockery basket 4 are each assigned their own image detection system which can each consist of a plurality of the afore-mentioned photosensitive pixel elements. The image detection systems 31, 32 are preferably positioned in such a manner that a comprehensive image of the items to be washed in the respective crockery baskets 3, 4 is possible. Furthermore, a plurality of image detection systems could be allocated to each crockery basket, and the three-dimensional images determined by the image detection systems can be interlinked and evaluated by the evaluation unit 35.

The image detection system 33 is allocated to a filter 17 which is used to collect contaminant residue during the sequence of a washing program. Since the cleaning performance of a dishwasher machine decreases as the filter becomes increasingly occupied, a signal which is recognizable for the user can be emitted by means of the image detection system 33, informing the user about the cleaning of the filter 17.

Depending on the intervals at which or the time points at which the image detection systems are activated, a dishwasher program can be started automatically. For example, the load of items to be washed could be detected after the respective closure of the appliance door in order to decide whether a sufficient load is already present in the washing chamber. The automatic program start can be made dependent on the quantity of items to be washed in the dishwasher machine and also on the type of items to be washed placed in the crockery baskets.

What is claimed is:

1. A method for determining at least one of the type and the quantity of items to be washed in a dishwasher machine, the dishwashing machine having a washing chamber in which the items are placed in receptacles for subsequent washing of the items during a dishwashing program with the respective disposition of the items in the receptacles constituting the load of the receptacles in the washing chamber of the dishwasher machine, the method comprising:

detecting the load of the receptacles by an image detection system that measures distances in a non-contact manner by means of the speed of light such that the measured distances can be evaluated to obtain a three-dimensional image of the washing chamber.

2. The method according to claim 1, wherein detecting the load of the receptacles by an image detection system includes emitting modulated electromagnetic waves into the washing chamber, whereupon waves are reflected by surfaces in the washing chamber, and evaluating the reflected waves by means of a sensor having two outputs which are alternately read by an evaluation unit in order to obtain information on the transit time of the electromagnetic waves.

3. The method according to claim 1 and further comprising performing an image recognition of the type and quantity of the load of the washing before beginning a washing program started by a user.

4. The method according to claim 1, wherein detecting the load of the receptacles by an image detection system includes detecting at least one of the type and the quantity of items to be washed at predetermined intervals to determine a change in the items to be washed in the receptacles and to trigger an automatic start of the dishwasher machine when a predetermined occupancy of the receptacles is established.

5. The method according to claim 1, wherein detecting the load of the receptacles by an image detection system includes detecting the items to be washed during a selected one of introduction of the items into the washing chamber and loading of the items into the receptacles.

6. The method according to claim 1, wherein detecting the load of the receptacles by an image detection system includes executing an image recognition of the washing chamber when the items to be washed are placed in the receptacles.

7. The method according to claim 1 and further comprising comparing an actual load of the washing chamber detected by the image detection system with a comparative image of a fully loaded dishwasher machine that has been generated and then stored in a memory in an evaluation unit of the appliance and evaluating the result of the comparison as a criterion for the automatic program start and the suitable washing program of the dishwasher machine.

8. The method according to claim 1 and further comprising adjusting a washing program as a function of the information determined by the image detection system.

9. The method according to claim 1 and further comprising identifying a filter filled with contaminant residue in the dishwasher machine as a function of the detected load.

* * * * *